United States Patent [19]

Dannenberg

[11] Patent Number: 4,745,836

[45] Date of Patent: May 24, 1988

[54] METHOD AND APPARATUS FOR PROVIDING COORDINATED ACCOMPANIMENT FOR A PERFORMANCE

[76] Inventor: Roger B. Dannenberg, 6529 Aylesboro Ave., Pittsburgh, Pa. 15217

[21] Appl. No.: 789,064

[22] Filed: Oct. 18, 1985

[51] Int. Cl.[4] ..... G10H 1/36

[52] U.S. Cl. ..... 84/1.03; 84/DIG. 12

[58] Field of Search ..... 84/1.03, 1.28, DIG. 12, 84/DIG. 22, 1.01

[56] References Cited

U.S. PATENT DOCUMENTS

| | | | |
|---|---|---|---|
| 4,484,507 | 11/1984 | Nakada et al. | 84/1.03 |
| 4,485,716 | 12/1984 | Koike | 84/1.03 |
| 4,506,580 | 3/1985 | Koike | 84/1.01 |
| 4,602,544 | 7/1986 | Yamada et al. | 84/1.01 |
| 4,630,518 | 12/1986 | Usami | 84/1.03 |
| 4,651,612 | 3/1987 | Matsumoto | 84/1.03 |

*Primary Examiner*—Stanley J. Witkowski

*Attorney, Agent, or Firm*—Arnold B. Silverman

[57] ABSTRACT

A computerized method and apparatus for providing a comparison between a performance and a performance score in order to provide coordinated accompaniment with the performance. The performance is converted into a performance related signal and is compared with a performance score. If a predetermined match exists between the performance and the performance score, accompaniment is provided. This is preferably accomplished on an event by event basis. Dynamic programming is preferably employed. The algorithm may be adapted to determine a match exists even though the performance departs from the performance score in respect of either content or timing up to a predetermined level.

35 Claims, 5 Drawing Sheets

PERFORMANCE:

| SCORE: | A | G | E | D | G | B | C |
|---|---|---|---|---|---|---|---|
| A | 1 | 1 | 1 | 1 | | | |
| G | 1 | 2 | 2 | 2 | | | |
| E | 1 | 2 | 3 | 3 | | | |
| G | 1 | 2 | 3 | 3 | | | |
| A | 1 | 2 | 3 | 3 | | | |
| B | 1 | 2 | 3 | 3 | | | |
| C | 1 | 2 | 3 | 3 | | | |

FIG. 6

PERFORMANCE:

| SCORE: | A | G | E | D | G | B | C |
|---|---|---|---|---|---|---|---|
| A | 1 | 1 | 1 | 1 | 1 | 1 | 1 |
| G | 1 | 2 | 2 | 2 | 2 | 2 | 2 |
| E | 1 | 2 | 3 | 3 | 3 | 3 | 3 |
| G | 1 | 2 | 3 | 3 | 4 | 4 | 4 |
| A | 1 | 2 | 3 | 3 | 4 | 4 | 4 |
| B | 1 | 2 | 3 | 3 | 4 | 5 | 5 |
| C | 1 | 2 | 3 | 3 | 4 | 5 | 6 |

FIG. 7

PERFORMANCE:

| SCORE: | A | G | E | D | G | B | C |
|---|---|---|---|---|---|---|---|
| A | 1 | 1 | | | | | |
| G | 1 | 2 | 2 | | | | |
| E | 1 | 2 | 3 | 3 | | | |
| G | | | 3 | 3 | 4 | 4 | |
| A | | | | 3 | 4 | 4 | 4 |
| B | | | | | 4 | 5 | 5 |
| C | | | | | | | 6 |

FIG.8

METHOD AND APPARATUS FOR PROVIDING COORDINATED ACCOMPANIMENT FOR A PERFORMANCE

BACKGROUND OF THE INVENTION

1. Field Of The Invention

The present invention relates to a method and associated apparatus for providing coordinated accompaniment with respect to a performance and, more specifically, it relates to the use of a computer in accomplishing this objective.

2. Description Of The Prior Art

It has been known to provide various forms of musical or other accompaniment to a performance of the nature of a vocalist or musical instrument, for example. A simple example of such prior known practices would be a vocalist creating a singing performance with a band or orchestra providing musical accompaniment. In such a situation, the human beings performing the vocal and providing the music use their senses and musical skills to attempt to effect time coordination of the performance and the accompaniment.

It has also been known to provide previously recorded instrumental accompaniment to a vocalist. In such case the vocalist must adapt his or her timing to attempt to synchronize with the pace of the prerecorded music.

Computers have been used to respond to musical or other signals in various ways. For example, computer activated lighting systems have been controlled by predetermined fixed timing sequences and operated by a human. It has also been known to use computer music systems to store scores and perform them on human command. In some cases the rate or tempo has been adjusted by a human operator. In these cases, the operator must give specific and accurate instructions or cues to the computer if there is a need to synchronize the computer performance with other events.

Computer systems have also been built to generate or compose sounds and other events in response to musical and digital inputs from a live performer. In these cases, automatic synchronization and accompaniment can be achieved, but the system does not find a correspondence between the performance and a predetermined score, and the accompaniment is not read from a predetermined score.

In spite of the previously knowm systems, there remains a need for an improved means of providing accompaniment for a performance in an effective time coordinated manner.

SUMMARY OF THE INVENTION

The present invention has met the above-described need by providing a method and associated apparatus for comparing a performance with a performance score and providing accompaniment with respect thereto.

The method contemplates converting at least a portion of the performance into a performance sound, as hereinafter defined, effecting comparison between the performance sound and a performance score and if a predetermined match exists between a performance sound and a performance score providing accompaniment for the performance. The accompaniment score is preferably combined with the performance and may be uttered solely or conjunctly as through synthesis means, for example.

An algorithm which permits comparison between the performance and the performance score on an event by event basis may be established in such fashion that the performance omission of a note, inclusion of a note not in the performance score, improper execution of a note or departures from the score timing may be compensated for.

The performance may be heard live directly or may emerge from the synthesis means with the accompaniment. In general, matching means will receive both a machine-readable version of the audible performance and a machine-readable version of the performance score. When a match exists within predetermined parameters, a signal will be passed to the accompaniment means which also receives the accompaniment score and subsequently the synthesis means will receive the accompaniment with or without the performance sound.

The apparatus may include means for providing a performance sound, performance score means, matching means for comparing the performance sound with the performance score means to determine if a match exists and uttering a match signal when a match exists and accompaniment means for receiving the match signals and an accompaniment score. Synthesis means emits the accompaniment alone or in cases where the performance is to be made through the apparatus as distinguished from being separately heard the performance sound as well.

It is an object of the present invention to provide an efficient method and associated apparatus for effecting a time related comparison of a performance as hereinafter defined with a score and uttering in time related manner an appropriate desired coordinated accompaniment, as hereinafter defined.

It is a further object of the present invention to provide such method and apparatus which is adapted for use with both monophonic and polyphonic systems.

It is yet another object of the present invention to provide such a process and apparatus which is adapted to compensate for minor departures in the performance from the score.

It is an object of the present invention to provide accompaniment which is effectively coordinated with a performance even when the performance has departed from the performance score.

It is another object of the present invention to provide a method and apparatus for detecting discrepencies between a performance and a performance score.

These and other objects of the invention will be more fully understood from the following description of the invention, on reference to the illustrations appended hereto.

BRIEF DESCRIPTION OF THE DRAWINGS

FIG. 6 is a matrix showing correspondence between performance and performance score after a number of events.

FIG. 7 is a matrix showing matching effect between performance and performance score.

FIG. 8 shows a matrix of performance and related performance score employing a reduced window.

DESCRIPTION OF THE PREFERRED EMBODIMENT

As used herein, the term "performance" means the generation of one or more sounds or one or more sound related signals or coded signals simultaneously or sequentially by live or prerecorded means or both, including but not limited to sound created by electronic or orchestral musical instruments, a vocalist, an accoustical or electronic keyboard or combinations thereof.

As used herein "performance sound" means the sound or sound related signal or coded signal generated in a performance.

As used herein "accompaniment" means one or more sounds or sound related signals or coded signals adapted to provide an audible, visual, audio visual or other coordinated accompaniment for a performance.

As used herein "score" means a predetermined sequence and timing of every expected event used in a performance or accompaniment.

Figure 1:
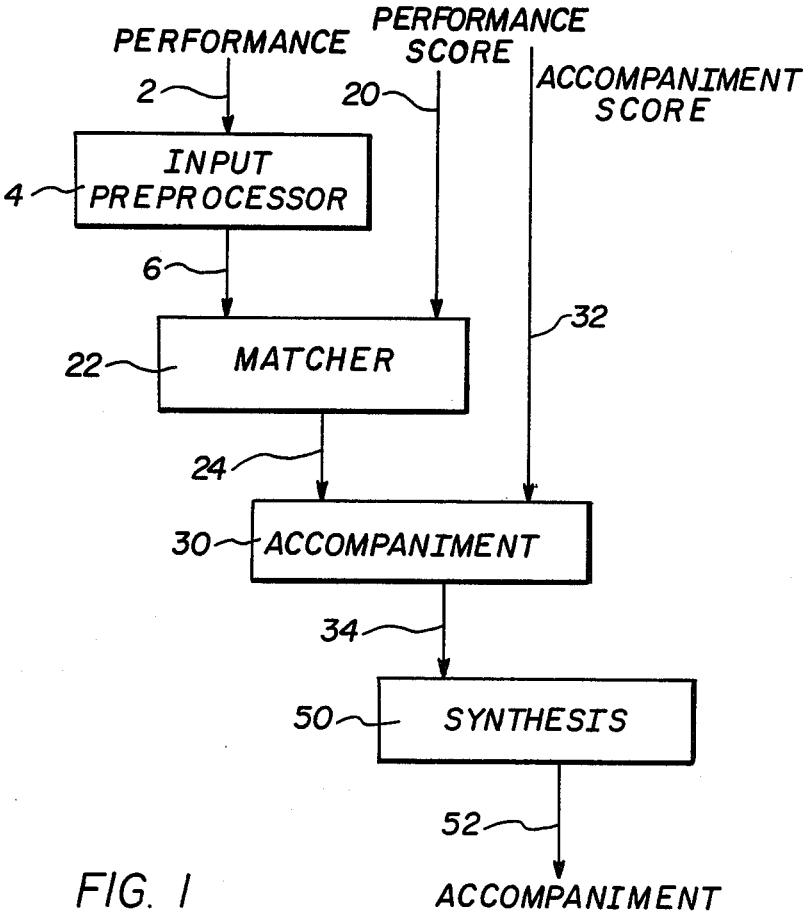
FIG. 1 is a schematic flow diagram showing a preferred embodiment of the invention.

Referring now more specifically to FIG. 1, certain preferred features of the invention will be considered in greater detail. The performance generates a sequence of sound, sound related signals, or coded signals which are, as indicated at 2, introduced into the input preprocessor 4. This preprocessor 4 converts the input sound or signal into a sequence of corresponding machine-readable symbols for computerized processing. The input preprocessor 4 may advantageously contain or consist of a pitch detector or pitch extractor. The output of input preprocessor 4 as is indicated at 6 is introduced into matcher 22.

The performance score, as is indicated at 20, is also introduced into matcher 22. In a manner to be described hereinafter in greater detail the matcher 22 provides a detailed symbol by symbol comparison between the performance and performance score as to identity of sound and timing. When a match occurs within the parameters provided by the algorithm to be described hereinafter, matcher 22 introduces a responsive signal through 24 into accompaniment 30. The signal includes the virtual time of the matched performance event. Accompaniment score is also introduced into accompaniment 30 by path 32.

The performance score and the accompaniment score are both machine-readable descriptions of the desired performance indicating both the expected event and the expected time of the event. The timing in the performance score and accompaniment is considered "virtual time" which is "warped" into real-time as is necessary to match tempo deviations in the real-time performance. In accompaniment 30 a variable speed or "virtual time" clock is maintained. The accompaniment 30 uses the signal from the matcher 22 to reset the variable speed clock and to adjust the speed. This facilitates obtaining a close and continuous correspondence between the passage of virtual time in the performance and the time on the clock. The clock time is used to schedule and execute events in the accompaniment score by sending events at the appropriate time to its output 34. The output of accompaniment 30 through path 34 goes to synthesis 50 wherein the performance and accompaniment score are synthesized and emitted through path 52 to an amplifier, recording device or other desired apparatus. Accompaniment 30 has a real-time clock. Time in the performance score and the accompaniment score is adjusted in the accompaniment means to correspond to the live performance. Score time as used herein will be referred to as virtual time and actual performance time is real-time. Virtual time is altered in order to accomplish a change in speed.

It will be appreciated that the matcher 22 served to compare the performance with the performance score to determine correspondences between the performance and the performance score and report the points of correspondence to accompaniment 30. Based on the information which the accompaniment 30 receives from the matcher 22, it determines how and when to perform the accompaniment. Synthesis 50 provides hardware and software to generate sounds according to the commands from accompaniment 30.

In order for matcher 22 to function efficiently in effecting the comparison between the performance and the performance score, determination as to the degree of mistakes or departures from the performance score which will be tolerated in the performance with respect to the performance score must be made in the matcher 22. The matcher 22 must also produce an output in real-time as the performance is rendered. The present method and associated apparatus contemplate monitoring monophonic or polyphonic performances and the time sequence between successive sound. In a manner which will be described in detail hereinafter, one of the unique aspects of the present system is that the matcher 22 employs dynamic programming to determine the correspondence between a stored sequence (the performance score) and the real-time input sequence (the performance).

By way of example and not limitation, a suitable digital computer such as an IBM PC may be employed with the software to function as the matcher 22 and accompaniment 30. A suitable input preprocessor 4 is that sold under the trade designation PitchRider, pitch to MIDI converter, by Cherry Lane Technologies of Port Chester, N.Y. A MIDI to IBM PC interface which is suitable is the MPU-401 sold by Roland Corp. of Los Angeles, Calif. A suitable synthesizer is that sold under the trade designation JUNO-106 by Roland Corp.

Figure 2:
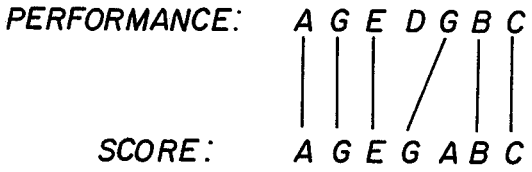
FIG. 2 is an illustration of a performance and corresponding performance score.

Referring now in greater detail to FIG. 2, a schematic illustration of correspondence between a portion of a performance and performance score is provided. The solid lines connecting identical letters serve to provide a graphic indication of the manner in which, in a monophonic performance and score the best association is established. It may be assumed that each capital letter refers to a distinct note and that time elapses in moving from left to right along the succession of letters. For example, the straight line connecting the performance letter "A" with the score "A" indicates that the performance has resulted in a sound "A" being introduced by path 2 into the input preprocessor 4 of FIG. 1 and the associated machine-readable symbol being introduced into matcher 22 through path 6. The performance score has an indication that the letter "A" should appear at that point in sequence and this is introduced through path 20 in machine-readable symbol form. In effecting the comparison in respect of both the identity of sound and timing or permissible predetermined departures therefrom, the matcher 22 determines that the two correspond and emits an appropriate signal over path 24 to accompaniment 30 which serves to combine the appropriate segment of the accompaniment score with the signal received from matcher 22.

The same is true in respect of the letters "G" and "E". It will be noted, however, that the performance generated a sound "D" for which there was no corresponding sound in the performance score. The present system compensates for such possible errors in the performance. In the form illustrated in FIG. 2, compensation occurs through ignoring the sound "D" and creating a match will subsequently generated sound "G". This sort of approach is taken where sounds not in the score are provided in the performance.

Continuing to refer to FIG. 2, it is noted that the performance score contains a second letter "A" but the performance did not generate a corresponding sound. As a result, in the matcher the dynamic programming ignores this as no match exists. Subsequently, matches are found between the corresponding letters "B" and "C". A further example of a predetermined acceptable departure from identical matching which may be treated as a match would occur when a performance results in an attempt to execute a given note, but does so imperfectly, for example, the performance may produce an A sharp when the score calls for an A.

In establishing the algorithm for use, one must determine to what extent departures from a performance score will be tolerated and the manner in which the accompaniment will be adjusted to take care of the same.

Figure 3:
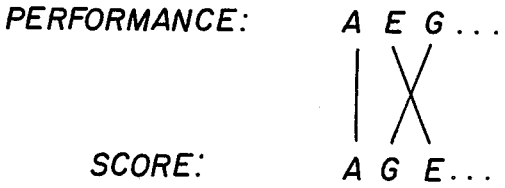
FIG. 3 is an illustration of an invalid association between a performance and score.

Referring to FIG. 3, a slightly different departure from the desired sequence is provided. Whereas in FIG. 2 in one instance the performance provided a sound or event not contained in the performance score and in the other it omitted a sound which was contained in the performance score, in FIG. 3, the performance provides two sounds which are in the performance score, but provides them in reverse sequence. Although conventional dynamic programming would not inherently construct a match as illustrated in FIG. 3, modifications to match reversed sequences or polyphonic sequences are achievable extensions to dynamic programming. Through use of dynamic programming, the "A" sounds are matched and the "E" and "G" sounds which were produced in reverse order are connected.

GLOSSARY OF TERMS

Figure 4:
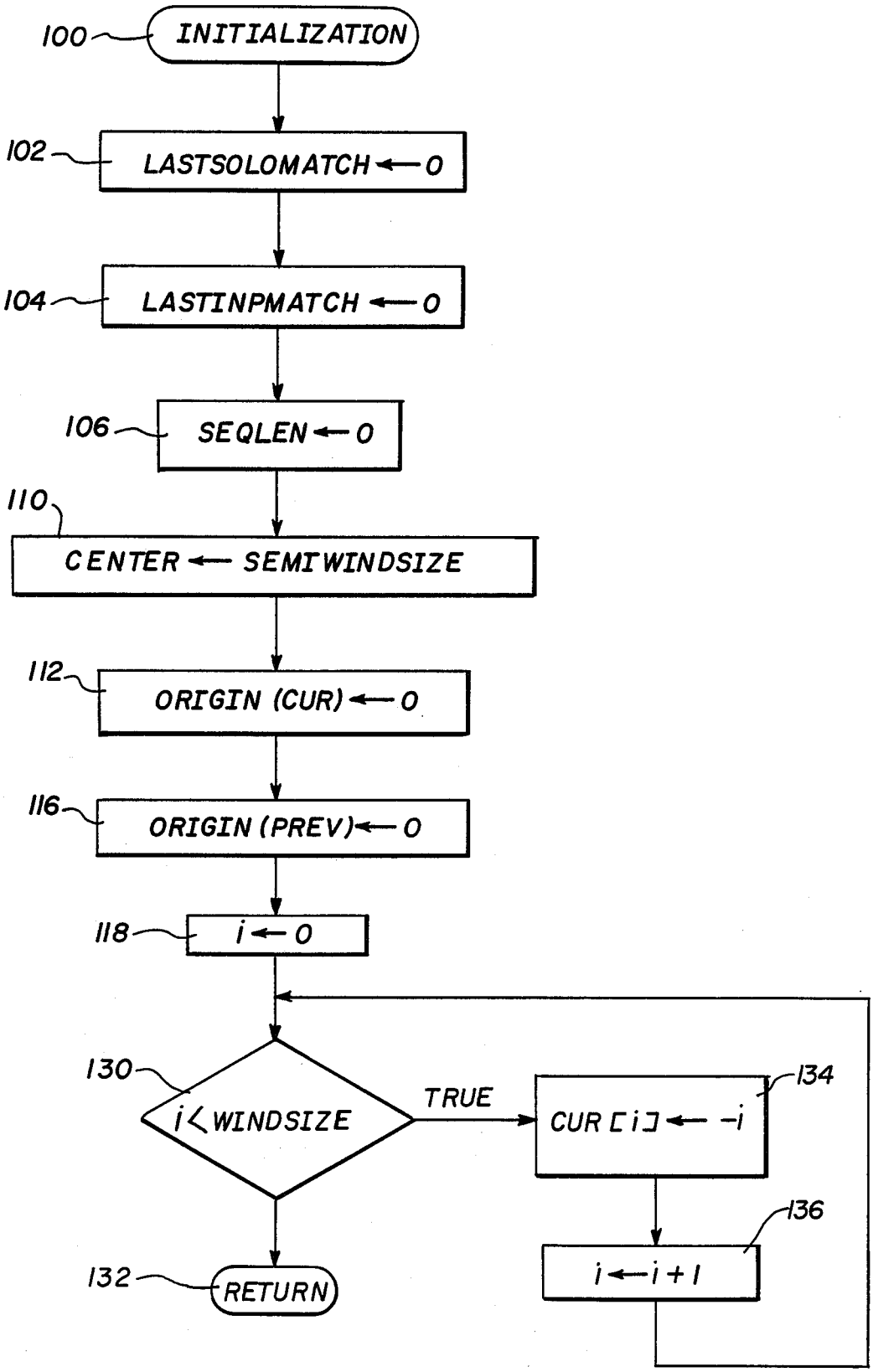
FIG. 4 is a flow diagram of a preferred form of initialization.
Figure 5A:
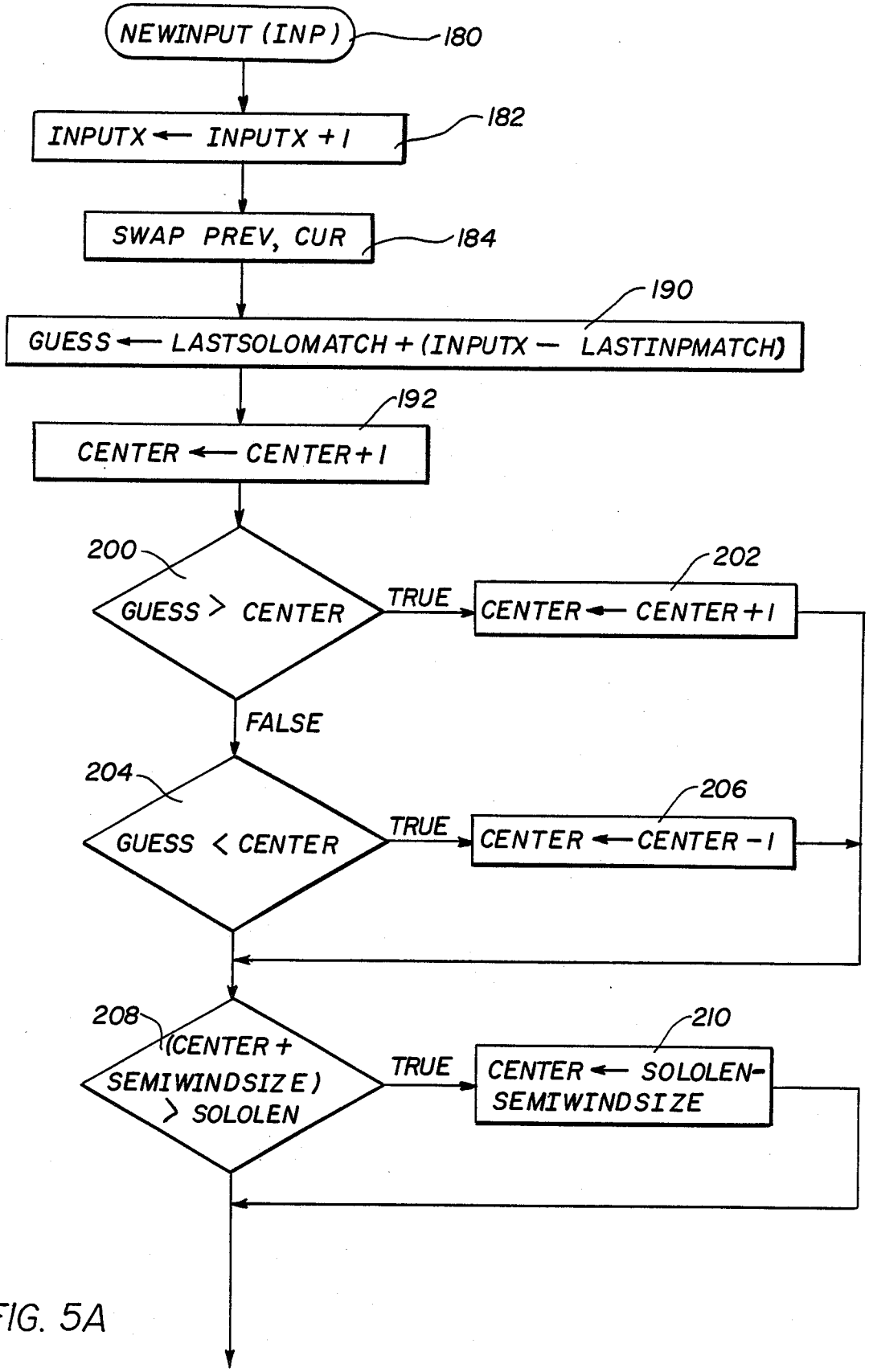
FIGS. 5A and 5B combined create a flow diagram of a preferred embodiment of the invention.
Figure 5B:
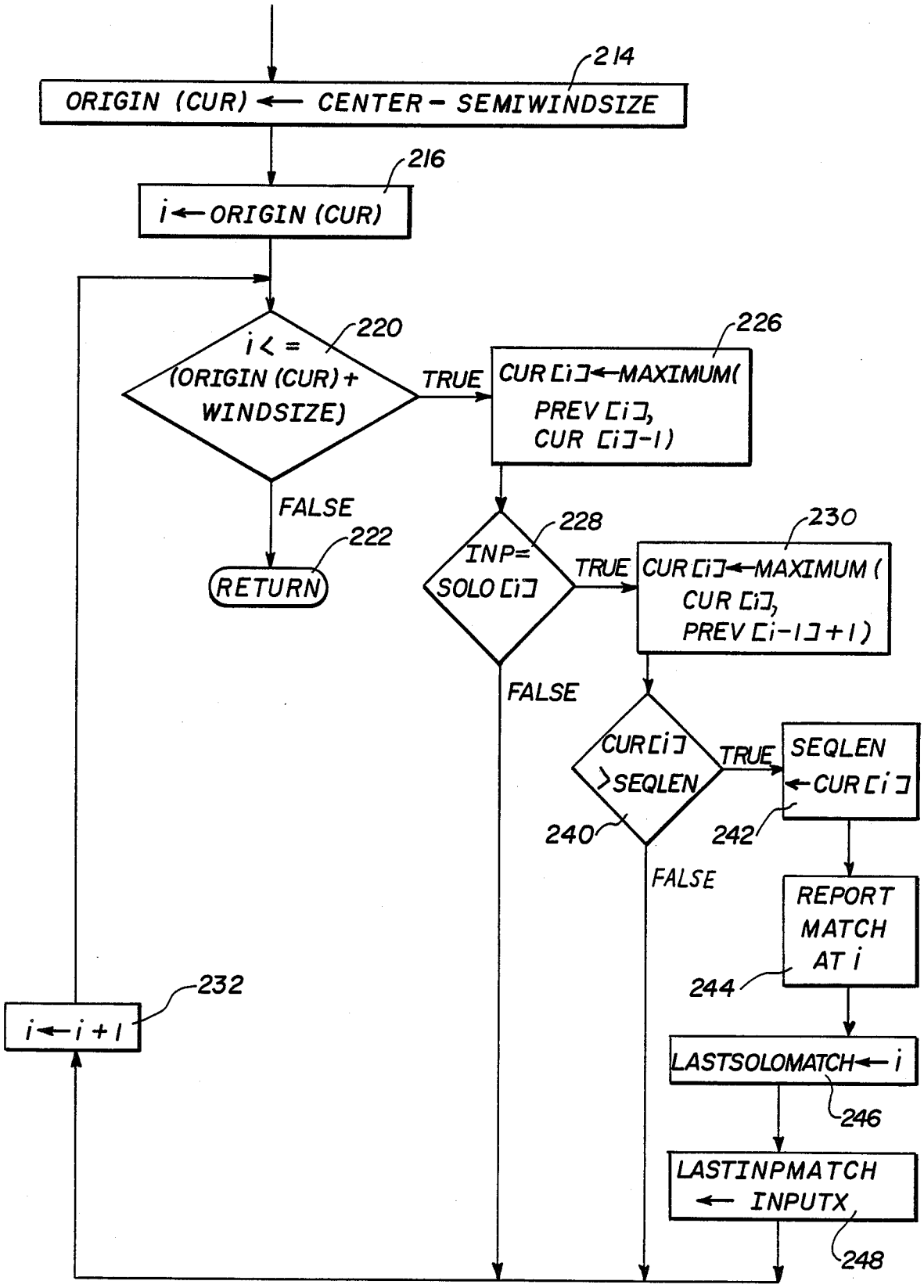

In considering the flow chart illustrated in FIGS. 4, 5*a* and 5*b*, the following terms will have the indicated meanings.

lastsolomatch—the index into the score array of the last score symbol that was matched.

lastinpmatch—the index of the performance input at the last match.

seglen—the number of symbols that have been matched in the best correspondence between the performance input and the performance score.

center—the index within the performance score of the center of the window which is a data structure described hereinafter.

windsize—the number of elements in the window data structure to be described hereinafter. This is always an odd number and it is a constant throughout the program.

semiwindsize—the size of the window data structure minus one and that whole quantity divided by two. It is one-half the window size minus one and this is a constant throughout the program.

cur and prev—refer respectively to current window and previous window. These windows store portions of columns of the matrix to be computed as illustrated in FIGS. 5, 6 and 7, and the data structures have the property that they can store windsize components. The data structures are indexed by a number corresponding to rows. The origin, i.e. the index of the first element of the window can be changed by the program in order to conveniently position the window starting at any given row. Windows are not normally provided by programming language and should be implemented by additional software. An example of a window data structure implementation is given in the first listing set forth hereinafter between lines 157 and 260. "Origin window" followed by an arrow pointing to the left and a number designates an assignment of the number to be the origin of a given window.

i—is used as an index.

guess—is used within the procedure newinput as a temporary value used to compute the new center of the window.

inputx—is employed to keep track of the number of input performance sound events that have occurred and is also the number of times newinput has been called.

solo—is an array of the expected performance events and is matched against the performance score.

sololen—is the number of elements in solo.

Turning now more specifically to the flow chart of FIGS. 4 and 5*a* and 5*b*, before using the matching algorithm, initialization sets the following variables to zero:

lastsolomatch, lastinpmatch, seqlen and i. The variable center is set to semiwindsize and the origins of the cur and prev data structures are set to zero. Subsequently, a loop is entered to initialize cur such that the value of the $i^{th}$ row of cur is the negative of i as shown in the lower part of the initialization flow chart. Once initialization is complete, the system should call the routine newinput each time a new performance symbol is input from the solo passing the symbol as the parameter inp. Newinput begins by incrementing inputx by one in order to keep count of the number of symbols input to that point. Newinput then swaps the values of the prev and cur data structures so that what was cur (which stands for current) is now prev (which stands for previous). This allows cur (which was the previous data structure) to be reused.

The next part of the algorithm computes a new origin for cur. This is done by first computing the variable guess as the sum of lastsolomatch and the difference between inputx and lastinpmatch. Guess is the expected center of the window based on the assumption that each input will match (or correspond) to one symbol in the solo score. Guess has the property that it tends to move the window forward from the last known match on each performance input event. It is preferred, however, that the window not be allowed to move too far in any one input. Otherwise, a match at some extreme point in the window might move the window too far. The window is, therefore, restricted (in this implementation) to move at most by two in the forward direction and is never allowed to move backward. This is accomplished in the next part of the flow chart by incrementing the variable center and then testing to see if guess is greater than the center. If so, center is incremented by one again; if not, then test whether guess is less than center and, if so, decrement center. The result will be that center is moved in the direction of guess but is limited to a maximum increment of two and is restricted so that no decrement can occur.

Next a test is made to make sure that the center has not moved so far forward that the window will actually move past the end of the solo score. The test is to determine if center plus semiwindsize is greater than sololen. If true, then we the window is centered at the end of the solo by assigning sololen minus semiwindsize to center. Next the origin of cur is set to center minus semiwindsize and i is set to the origin of cur.

At this point the matching actually begins and the value of cur of each element, the value representing the length of the best match up to the current input event will be computed. There is a loop beginning with the test to see if i is yet out of the index range of cur. If so, then the test will be false, the computation is done. If the test is true, then newinput is not finished and continues by setting the $i^{th}$ element of cur to the maximum of the $i^{th}$ element of prev and the $i-1$ element of cur minus 1. This computes the correct value of the $i^{th}$ element of cur if it is the case that there is no match between the current input and the $i^{th}$ event in the score. If there is a match, then the $i^{th}$ element of cur is set to the maximum of itself and the $i-1$ element of prev plus 1. After that, test if the $i^{th}$ element cur is greater than seglen and, if so, then a better match than the previous one is found, so set seglen to the $i^{th}$ element of cur and report the fact that there is a match between the current input element and the $i^{th}$ element of the solo score. To remember where the match occurred lastsolomatch is set to i and lastinpmatch is set to the value of inputx. Now increment i and repeat the loop.

In this manner, the preferred practice of the invention in providing performance matching with performance score in respect of sound or sound related functions is accomplished. The derivation of accompaniment is illustrated in the first listing which is described hereinafter.

The matching which is to be accomplished may be illustrated by considering a matrix of integers. An integer matrix is preferably computed where each row corresponds to an event in the performance score and each column corresponds to an event in the performance. A new column is computed for each performance event. The performance event may be a single note played on a musical instrument such as a trumpet, for example, or other desired portion of a performance which provides a meaningful unit for comparison purposes.

The integer computed for a given row r and given column c provides an answer to the question of if we are currently at the $r^{th}$ score event and the $c^{th}$ performance event what would be the highest rating of any correspondence up to the present time. The answer to this question can be computed from the answers for the previous column (the previous performance event) and from the previous row of the current column. The maximum rating or size of the correspondence as measured by the number of matching elements, for example, up to score event r, performance event c will be at least as great as the one up to $r-1$, c as considering one more score event cannot reduce the number of possible matches. Similarly, the maximum rating up to r, c will be at least as great as the one up to r, $c-1$, where one less performance event is considered. Furthermore, if score event r matches performance event c then the rating will be exactly one greater than the one up to $r-1$, $c-1$.

These rules can be applied to compute the maximum rating obtained by any association as shown by the following dynamic programming algorithm:

```
forall i,maxrating[i, -1] ← 0;
forall j,maxrating[-1,j] ← 0;
for each new performance event p[c] do
  begin
    for each score event s[r] do
      begin
        maxrating[r,c] ← max(maxrating[r - 1,c],
                             maxrating[r,c - 1]);
        if p[r] matches s[r] then
          maxrating[r,c] ← max[maxrating[r,c],
                    1+ maxrating[r - 1, c - 1]);
      end
  end
```

As each performance event is detected, the algorithm computes one more column in the maxrating matrix.

An advantage of the present system is that it, through use of dynamic programming in the matching algorithms, permits different rating functions to be employed to evaluate the quality of any given match. For example, the rating functions employed in the flow chart of FIGS, 4, 5A and 5B is the number of matches minus the number of events or notes which are not matched. Another example would be to employ the number of matches, notes or events minus the total number of unmatched notes in both the performance and the performance score.

FIG. 6 illustrates a matrix for the performance score AGEGABC after performance events AGED. The algorithm above computes the maximum rating, but it does not tell what events must be matched to obtain this rating. This information is required by the accompaniment process. Also, accompaniment requires an on-line algorithm i.e., one that gives result incrementally as the input becomes available. To meet these requirements the algorithm has been extended to report the position in the score of the current performance event. This is accomplished by remembering the maximum rating up to the current event. This is the largest value in the matrix yet computed. Whenever a match results in a larger value, it is assumed that a new performance event has matched a performance score event and it is reported that the performance is at the corresponding location in the score.

In FIG. 7, the matches that cause reports are underscored. It should be noted that the D which is performed, but is not in the score (see FIG. 2) does not give rise to a report of a score location. Also, when B is performed it becomes apparent that the soloist has skipped an A (see FIG. 2). The algorithm correctly reports the new location in the score that corresponds to the B.

In practice, only "windows" or a sub-column centered on the current location need be computed and only the previous column need be saved to compute the current one. Thus storage and computation per event are each bounded by constants. See FIG. 8. The use of windows only in areas where there is a high probability of a match improves efficiency of the system. This reduces the space and computation time required per performance event to within a fixed maximum.

As will be apparent from the foregoing analysis of the flow charts coupled with the rest of the disclosure herein, the present method and associated apparatus provides numerous benefits in accomplishing the desired objectives. First of all, it makes advantageous use of the concept of dynamic programming in order to find a correspondence between a storage sequence such as the performance score and a real-time input sequence such as the performance. This system also allows different rating functions to be used to evaluate the quality of any given match. For example, the rating function used in the flow chart is the number of matches minus the number of notes in the score that are not matched. Another example would be the number of matched notes minus the total number of unmatched notes in both the score and the performance. In general, the rating function can be any numeric function of a performance and a score prefix. The function should have the property that given the value of the function on a given performance and the score prefix, it is efficient to compute the function if (1) a new element is appended to the score prefix, (2) a new element is appended to the performance, and (3) single elements are appended to each.

Rather than computing the rating function for each prefix of the score, it is preferred that the function is computed only in the region centered on the expected location of the performance event. This serves to reduce the space and computation time for performance event to within a fixed maximum. This preferred approach to limiting the region thereby facilitating use of dynamic programming on a real-time basis will, for convenience of reference herein, be referred to as using "windows".

Results are derived from each new performance event. While the conventional dynamic programming algorithm would return the correspondence between the performance and performance score only after the complete performance, the present adaptation of the algorithm preferably uses the computed ratings to report likely or expected matches at intermediate stages of the computation.

In order to disclose the best mode known to applicant of practicing the invention, two listings of the algorithms are provided. The first listing immediately follows the description and contains lines 1 through 595.

The programs as presented herein are in the C programming language.

The organization of the program is in a number of modules each one dealing with a separate aspect of the problem. Lines 31 through 47 provide a few definitions. Lines 68–109 define routines for reading performance input. Lines 137–156 define the score for both the solo performance and accompaniment. Lines 169–260 implement the window datastructure which is used by the matching module. Lines 270–329 implement a virtual time module. Lines 346–451 control the accompaniment which is the output of the system and lines 468–562 perform the pattern matching algorithm to enable following the performance. Finally, lines 573–595 constitute the main control program.

Returning to the pitch module, there are two routines that are used by other modules. The first routine pitchinit should be called at the beginning of the program and its only purpose is to set up the variable currentkey to the value NONOTE which means no note is currently being played. The other routine readnote is used to determine if a key is being played and readnote works by calling a routine called chkinput whose purpose is to scan the keyboard and find out if there is any new data. In other words, chkinput looks to see if a key has been pressed or released. Then in line 91, the routine getkey returns the value of any event that has occurred. If no event has occurred, then getkey will return the value negative one (−1) and readnote will return the value negative one (−1) indicating that no note was played. On the other hand, if getkey returns a value between 0 and 127, that indicates that a key has been pressed and the value of k will be the number of the key, so the response of readnote in line 94 is to set the pitch of an oscillator to the pitch corresponding to the note that was pressed. Then in line 95, a check is made to see if a key was pressed previously in which case the oscillator is already sounding and only the change in frequency was necessary. In the case that no note was previously sounding, then it is necessary to increase the amplitude on the oscillator from 0 to some value which can be heard and that is accomplished in line 98. Then in line 100, it is recorded that k is the current key which is sounding and a value based on k is returned in line 101. Lines 102–106 handle the case where the event read from the keyboard was a key release and in this case, a check is made to see if the key released corresponds to the pitch sounding on the oscillator, and if so, then the oscillator is turned off in line 104 and current key is set to the value of negative 1 indicating that no note is sounding.

In summary, the pitch module (lines 68–109) mainly provides a routine called readnote that will read an input from a keyboard performance and whenever a key is pressed, readnote will return the number of that key. If readnote is called and nothing has happened since the last time readnote was called, then a special value NONOTE is returned.

Moving to the next module, the purpose of the score module is to initialize datastructures containing the score for the solo and for the accompaniment. This initialization could be done by reading data from a disk or a read only memory, but in this case, the score is actually encoded into the program itself to simplify the module. The datastructures, as mentioned in the comments in lines 119–135, are the following. An array solo gives a number corresponding to the pitch of each note in the solo performance. A corresponding array solotime is the starting time of the corresponding note in the solo and the array sololink contains the index of the next accompaniment note to be started after the corresponding note of the solo. A number in sololink refers to an index in the array accomp as defined on line 129. Accomp gives the pitch of each note of the accompaniment. There is a corresponding array acctime that contains the starting time of each note in the accompaniment. And finally, there is an array accdur that gives the duration of each note of the accompaniment.

In lines 133 and 134, it is mentioned that sololen is the length of the solo arrays and acclen is the length of the accompaniment arrays.

Throughout the program, durations are expressed in hundredths of seconds and pitches are expressed as integers where 48 corresponds to middle C and an increment by 1 corresponds to a pitch increment of 1 semitone.

The next module (lines 172–260) implements windows which are special datastructures used by the matcher. A window structure has the following properties. It consists of a sequence of elements that are indexed by integers. The window is of fixed size. The way in which elements are numbered can be altered. In other words, the index of the first element can be changed at will and this renumbers each of the other elements in sequence.

Other operations provided are access to an element given an integer, setting the value of an element at any specified index, and reading the index of the first element or in the index of the last element.

Looking at the code, line 172 defines a constant called semiwindsize and line 173 defines windsize to be the sum of twice semiwindsize and 1. Windsize is the number of elements in the window structure. In line 175, a special value called outside is defined and this is the value returned when an attempt is made to access a value which falls outside the range of the window. Lines 177–181 define the structure of the window. It consists of an array called window of size windsize and two additional integers, first and last, that are used to keep track of the correspondence between an index and a structure element. Several of these structures are defined in line 183 and lines 186–193 define a procedure that initializes these window structures. Windinit should be called at the beginning of the program. The operation wswap can be called to swap the value of the two windows named prv and cur. In lines 206–215 is a routine wget that takes two input parameters. The first, w, is a window and the second, i, is an index. Wget uses the index to find an element in the window and returns that value. If the index falls outside of the window, then the value outside is returned. Lines 218–220 define a routine wfirst which given a window will return the index of the first element in the window. Similarly, wlast defined in lines 223–225, takes a window as its input parameter and returns the index of the last element of that window.

The values stored in the window datastructures are integers. To change the value of an element, wset is called. Wset is defined in lines 228–236 and takes three parameters. The first, w, is the window to be modified. The second parameter, i, is the index of the value to be modified and the third parameter, v, is the new value to be stored at that index location.

The correspondence between an index and the corresponding element can be changed by calling the routine wlocate defined between lines 239 and 247. Wlocate takes two parameters. W is a window and center is the desired index of the center of the central element of the window. The last routine, dumpwindow, is used strictly for debugging and is not called from anywhere within the program so its function can be safely ignored.

The next module is designed to implement virtual time. Virtual time is time that is referenced to an arbitrary point in real-time and progresses at arbitrary rates relative to real-time. Virtual time in the form disclosed is simulated by software and is based upon a hardware real-time clock. The function of the virtual time module is similar to that of a mechanical clock with adjustable time and adjustable speed. The routine virtinit defined between lines 275 and 282 should be called at the beginning of program execution. Within this routine, a call is made to the function gettime which must be provided by the computer system and gettime always returns the elapsed time in hundredths of a second from the beginning of the program execution.

The function realtovirt is used within the virtual time module to convert real-times into virtual times. The relationship between real-time and virtual time is recorded as follows. There is a value called rtref that establishes a real-time reference point. The virtual time that corresponds to that real-time is stored in vtref and the rate at which virtual time is passing relative to real-time is stored in tfactor. The integer tfactor is 100 times the rate of virtual time relative to real-time. The conversion from real-time to virtual time is straightforward and expressed by the formula that appears in line 290 of the program listing. Lines 294–299 define the routine virttime that when called returns the current virtual time. This is implemented in line 298 by getting the real-time and then converting real-time to virtual time. The rate of virtual time can be adjusted by calling one of two routines. The first, speedup, appears in lines 302–307. The other routine appears in line 310–315 and is called slowdown. These routines change the rate of virtual time by incrementing or decrementing tfactor. Whenever the virtual time is known, the virtual clock can be set by calling setref. The parameter to setref is virtual time and setref is defined in lines 318–329. In addition to setting the virtual clock, setref has the side effect that whenever the clock is set forward, the routine speedup is called and whenever the clock is set backward, the routine slowdown is called.

Accompaniment is generated in the next module between lines 330–451. The general idea of this module is to read the accompaniment score and use the virtual clock to determine when musical accompaniment events should take place. This particular accompaniment is a single voice or monophonic accompaniment. One may readily expand accompaniment to deal with polyphony by replacing accompaniment notes with events whose action is to turn polyphonic notes on and off. The module maintains an index into the accompaniment score called accx defined in line 346. The variable accon defined in line 347 remembers whether an accompaniment note is turned on yet or not. Line 348 defines the variable rampdone that remembers when a change in amplitude is due to be completed. This has to do with the internal details of the particular synthesizer being controlled by this module.

Line 349 defines a flag variable called accdoneflag that is initially false, but is set to true when the accompaniment finishes. The variable stoprequest defined in line 350 is another flag that is defined to be true when the end of a note was requested but the attackramp has not yet ended. This also has to do with the internal details of the synthesizer that is generating sound.

In lines 355–364 is defined accinit that should be called at the beginning of program execution to initialize variables. The routine defined in lines 367–379, finishnote, has an input parameter now containing the real-time. The function of finishnote is to turn off the sound of the synthesizer producing the accompaniment. This is done by either immediately sending a command to the synthesizer to turn the volume down to 0 as in line 375 or if the synthesizer is in the middle of a command to turn a note on, then the stoprequest flag is set to true as shown in line 372. Again, this routine is specific to a particular synthesizer.

The accmpny routine is called by the main program frequently in order constantly to update the synthesizer output in accordance with the score and with the score and with the virtual time clock. The routine first gets the real-time in line 392 and then determines if the synthesizer is busy in line 393. If the synthesizer is busy, then the routine returns immediately without doing any further work. Otherwise, the routine can be in three different states—it can be waiting to start a note, it can be waiting for the end of a note or it can be waiting for the attackramp to finish in order to start a decay which would turn a note off. These cases are handled in lines 405–422. Line 405 performs the check to see if a request to turn off the note has been issued and if that is the case then routine finishnote is called to turn the note off. Otherwise line 409 recognizes the state in which accmpny is waiting for the release of a note or the end of a note. Line 410 determines if the end of the note has indeed occurred and if so, then line 411 turns the note off. Line 412 checks to see if that was the last note in the score in which case accdoneflag is set to true. Otherwise, accmpny must be waiting for a note to start. Line 414 tests to see if there are any notes left. If not, accdoneflag is set to true line 415. If there are notes left to be played, then a test is made in line 416 to see if it is yet time to play that note and, if so, then line 417 increments accx so that it is indexing the next note to be performed. Then lines 418 and 419 set the pitch and turn the note on so that sound is produced and line 420 sets the flag accon to true to remember that a note has been turned on and finally, line 421 sets the time at which the note should be fully turned on.

The last routine in this module is accupdate which is called whenever virtual time has to be reset. If that occurs, then it may be necessary to jump from one location to another in the score and so some special processing needs to be done to adjust the output of the synthesizer to correspond to a new location in the score. There are three cases to consider. In the first case, the input parameter i which is the index of the next accompaniment note agrees with the current location in the score and so there is nothing to do. In the second case, the next note to be played happens to be the one that is currently sounding in which case, the note is left on. This is handled by lines 440–441. Otherwise, the accompaniment is playing the wrong note so the program should turn off the current note and move to the correct place in the score which may result in turning another note on. This is handled in lines 446–450.

The next module is the match module which takes the performance input and matches it against the stored performance score thereby producing information that controls the real-time clock which in turn guides the accompaniment and allows the accompaniment to speed up and slow down to follow a performance. The details of this module are given in the flow chart description in FIGS. 4, 5A and 5B. The matchinit routine should be called to initialize the module, and is defined in lines 475–494. This routine initializes a number of index variables and also initializes the window datastructures. Lines 497–506 define routine match which is called from within the matcher when a correspondence between the solo performance and the performance score is detected. The operation of match is to set the virtual clock. When match is called, the correspondence between real-time and virtual time is known. The second operation of match in line 505 is to call accupdate since setting the virtual clock requires the position in the accompaniment to be reset.

The routine in lines 509–515, max, is a routine to compute the maximum of two integers.

The matching algorithm itself is defined between lines 518 and 562. The routine is called newinput and it makes one parameter which is the pitch code of a performed note. The newinput routine first computes the location of the next window. The location is specified by the variable center and in line 545, the window is located at the specified center. Then the matrix computation is performed in a loop beginning at line 550 that computes the value of the matrix at each element of the current window corresponding to the column of the new performance event. If a match is detected then lines 555–558 will be executed. Line 556 is the call to the match routine that updates the virtual clock and informs the accompaniment that the clock has changed.

Finally, lines 563–595 define the main program. Execution actually begins at line 586. The first operation is to call the routine init in line 589. The init routine is defined between lines 573 and 583 and it in turn calls the initialization procedures in each of the other modules. These calls appear in lines 577–582. Once everything is initialized, the main program enters a loop from line 590 to line 594. Within the loop, the accmpny and readnote routines are called repeatedly. Whenever readnote returns a value indicating that a key was pressed by the performer, then the key which was pressed is passed to the routine newinput which is the routine that implements the matching algorithm.

```
1   /*************************************************************
2                C programs for real-time accompaniment
3                        by Roger B. Dannenberg
4
5
6   ChangeLog:
7                  rbd      Update lastinpmatch and lastsolomatch
7a                          in match.
8
9   Documentation:
10             I have integrated several modules into this
11  monolithic program to simplify testing and distribution.  The
```

```
12  principal  modules of the program are:
13             pitch -- reads pitch from solo instrument
14             score -- reads scores from a file
15             wind -- implements matrix column windows (used by
15a                     match)
16             virt -- implements virtual time for use by accomp
17             acc -- performs accompaniment according to virtual
17a                    time
18             match -- implements the score following/pattern
18a                      matching
19             control -- top level control program
20
21  The time unit throughout is 10ms.  The function gettime ()
22  returns time in units of 10ms.
23
24
25
26
27
28
29  ************************************************************/
30
31  #define begin {
32  #define end }
33
34  #define true 1
35  #define false 0
36
37  /* handy print/debugging macros:  */
38  #define out(var) printf("var: %d, ", var)
39  #define nl putchar('\n')
40
41  /* definitions for simple synthesis: */
42  #define ATTACK 5
```

```
43 #define DECAY 20
44 #define MAXAMP 127
45
46 #define OSC_S 0
47 #define OSC_A 1
48 /*************************************************************
49 pitch -- module to read pitch from input device
50          (this module also controls the synthesis of the solo)
51
52 imports:
53           getkey(), scale(), chkinput()
54 exports:
55           pitchinit(), readnote(), NONOTE
56
57 Notes:
58 getkey(0) is used to get input data from the keyboard, it
58a returns:
59           -1 if no key was pressed
60           n if key n was pressed
61           n+128 if key n was released
62 (keyboard inputs are queued until read by getkey)
63
64 scale(p) returns the synthesizer frequency value corresponding
65 to p chkinput() polls the keyboard interface for input
66 *************************************************************/
67
68 #define NONOTE -1
69
70 int currentkey; /* keeps index of key for key-up detection */
71
72 /* pitchinit -- initialize pitch detector here */
73 /**/
74 pitchinit()
75 begin
```

```
76          currentkey = NONOTE;
77 end
78
79
80 /* readnote -- read keyboard, synthesize appropriate sound */
81 /*
82          readnote always reports and plays the last key,
83          return NONOTE if no key event found
84 */
85 int readnote()
86 begin
87     int k;
88     chkinput(); /* this may be part of the synthesizer
88a     interface */
89         /* it checks to see if there is data from the keyboard
89a        scanner */
90         /* and must be called frequently for getkey to work */
91     k = getkey(0);
92     if (k >= 0 && k < 128) begin
93         /* note:  fdelay(f, 0, n) sets oscillator n to
93a           frequency f */
94         fdelay(scale(k+24), 0, OSC_S); /* set the pitch */
95         if (currentkey == NONOTE) begin
96             /* note:  aramp(d, a, n) produces an amplitude
97                 ramp with duration d, ending at amplitude a,
97a                on oscillator n */
98             aramp(ATTACK, MAXAMP, OSC_S); /* turn on envelope
98a            */
99         end
100        currentkey = k;
101        return (k+24); /* transpose keyboard to a normal range
101a       */
102    end else begin /* handle key up event */
103        if ((k >= 128) && ((k-128) == currentkey)) begin
```

```
104                 aramp(DECAY, 0, OSC_S);
105                 currentkey = NONOTE;
106             end
107             return (NONOTE);
108         end
109     end
110     /*************************************************************
111     score -- module implementing scores for solo and accompaniment
112
113     imports:
114
115     exports:
116             solo[], solotime[], sololink[], accomp[], acctime[],
117             accdur[], sololen, acclen
118
119     (The solo is numbered from 1 to sololen,
120      accomp is numbered from 1 to acclen --
121      the fact that solo[0] exists simplifies some of the matching
122      algorithm code.)
123
124     solo[i] is the pitch of the ith note of the solo
125     solotime[i] is the time of the ith note of the solo
126     sololink[i] is the index of the next accompaniment note to be
127             started after the ith note of the solo
128
129     accomp[i] is the pitch of the ith note of the accompaniment
130     acctime[i] is the time of the ith note of the accompaniment
131     accdur[i] is the duration of the ith note of the accompaniment
132
133     sololen is the length of the solo
134     acclen is the length of the accompaniment
135     *************************************************************/
136
```

```
137 /* test score from Lassus (atKisson, Basic Counterpoint,
137ap.44); */
138 /* because arrays start with index 0, the first array element
138ais there */
139 /* just to simplify the matching algorithm boundary
139a conditions. */
140 /* The score proper starts at index 1; for example, the solo
140a is: */
141 /* D5 brevis, F5 dotted whole, E5 quarter, D5 quarter, C5
141a half, A4 half, */
142 /* C5 dotted half, D5 quarter, E5 half, A4 half. (half
142a note=100=1 sec) */
143 solo[] = begin NONOTE, 62, 65, 64, 62, 60, 57, 60, 62, 64, 57
143a end;
144 solotime[] = begin 0,0,400, 700, 750, 800, 900, 1000, 1150,
144a 1200, 1300 end;
145 sololink[] = begin 0, 1, 1, 2, 2, 2, 3, 3, 4, 5, 6 end;
146 sololen = 10;
147
148 accomp[] = begin NONOTE, 50, 53, 52, 50, 48, 50, 53 end;
149 acctime[] = begin 0, 400, 800, 1100, 1150, 1200, 1300, 1400
149a end;
150 accdur() = begin 0, 375, 275, 25, 25, 75, 75, 126 end;
151 acclen = 7;
152
153 scoreinit()
154 begin
155         /* ordinarily, this routine would read in the score
155a        from a file */
156 end
157 /*************************************************************
158 wind -- a module implementing windows on matrix columns
159 imports:
160
```

```
161 exports:
162             windinit(), wget(), wset(), wlocate(), wfirst(),
163             wlast(), semiwindsize, windsize, prv, cur
164
165 This module exports two windows, cur and prv, to be used by
165a match.
166
167 ************************************************************/
168
169 /* Normally I use a semiwindsize of at least 5.  This program
170 uses a smaller value because the test score is very short;
171 */
172 #define semiwindsize 2
173 #define windsize (semiwindsize+1+semiwindsize)
174 /* this value is returned by wget for rows outside of the
174a window: */
175 #define outside -10000
176
177 struct windstruct begin
178     int window[windsize];
179     int first;
180     int last;
181 end;
182
183 struct windstruct *prv, *cur, *wstemp, ws1, ws2;
184
185
186 /* windinit -- initialize windows */
187 /**/
188 windinit()
189 begin
190     prv = &ws1;
191     cur = &ws2;
192     /* note:  wlocate must be called before using a window */
```

```
193 end
194
195
196 /* wswap -- swaps prv and cur */
197 /**/
198 wswap()
199 begin
200             wstemp = prv;
201             prv = cur;
202             cur = wstemp;
203 end
204
205
206 /* wget -- gets the value of window w at row i */
207 /**/
208 int wget(w, i)
209 struct windstruct *w;
210 int i;
211 begin
212     if (i < (w->first)) return (outside);
213     else if (i & (w->last)) return (outside);
214     else return ((w->window)[i-(w->first)]);
215 end
216
217
218 /* wfirst -- row number of beginning of window */
219 /**/
220 #define wfirst(w) (w->first)
221
222
223 /*  wlast -- row number of end of window */
224 /**/
225 #define wlast(w) (w->last)
226
```

```
227
228 /* wset -- sets the value of window w at row i to value v */
229 wset(w, i, v)
230 struct windstruct *w;
231 int i;
232 begin
233     if ((i < w->first) || (i > w->last)) begin
234         printf("wset over- or underrun\n");
235     end else w->window[i-(w->first)] = v;
236 end
237
238
239 /* wlocate -- center a window at the specified row */
240 /**/
241 wlocate(w, center)
242 struct windstruct *w;
243 int center;
244 begin
245     w->first = center-semiwindsize;
246     w->last = center+semiwindsize;
247 end
248
249
250 /* dumpwindow -- a debugging routine, prints window w */
251 /**/
252 dumpwindow(w)
253 struct windtruct *w;
254 begin
255     int i;
256     printf("window dump:\n");
257     for (i = w->first; i <= e->last; i++) begin
258         printf("    "); out(i); out(wget(w, i)); nl;
259     end
260 end
```

```
261 /*************************************************************
262 virt -- virtual time module
263 imports:
264             gettime()
265 exports:
266             virtinit(), virttime(), setref()
267
268 *************************************************************
269
270 int rtref;       /* real-time reference */
271 int vtref;       /* virtual time reference, see realtovirt() */
272 int tfactor;     /* time factor: speed of the virtual clock */
273
274
275 /* virtinit -- initialize this module */
276 /**/
277 virtinit()
278 begin
279     rtref = gettime();
280     vtref = 0;
281     tfactor = 100;
282 end
283
284
285 /* realtovirt -- convert real time to virtual time */
286 /**/
287 int realtovirt(rt)
288 begin
289     /* note the fixed point arithmetic */
290     return vtref + (((rt - rtref) * tfactor) / 100);
291 end
292
293
294 /* virttime -- get the current virtual time */
```

```
295  /**/
296  int virttime()
297  begin
298          return realtovirt(gettime());
299  end
300
301
302  /* speedup -- make the virtual clock go faster */
303  /**/
304  speedup()
305  begin
306          tfactor += 5;
307  end
308
309
310  /* slowdown -- make the virtual clock go slower */
311  /**/
312  slowdown()
313  begin
314          tfactor -= 5;
315  end
316
317
318  /* setref -- set the virtual clock */
319  /**/
320  setref(vt)
321  int vt; /* vt is the current virtual time */
322  begin
323      int temp;
324      temp = virttime();
325     rtref = gettime();
326     vtref = vt;
327     if (temp < vt) speedup();
328     else slowdown();
```

```
329 end
330 /*************************************************************
331 acc -- accompaniment generation module
332
333 imports:
334             accomp[], acctime[], accdur[], acclen
335 exports:
336             accmpny(), accdoneflag, accupdate()
337
338 accx is the index into accomp[] of the most recent note
339 accon is true if the note is on
340
341 accmpny polls the virtual time to make progress in the
342 absence of solo events
343 accupdate is called whenever virtual time is changed
344 *************************************************************/
345
346 int accx; /* current index into accomp[] */
347 int accon; /* true if the note is on */
348 int rampdone; /* time at which the amplitude ramp finishes */
349 int accdoneflag; /* truewhen accompaniment is finished */
350 int stoprequest;
351         /* true when end of note was requsted, but the */
352         /* attach ramp has not yet ended */
353
354
355 /* accinit -- initialize accompaniment */
356 /**/
357 accinit()
358 begin
359     accx = 0;
360     accon = false;
361     rampdone = 0;
362     accdoneflag = false;
```

```
363         stoprequest = false;
364     end
365
366
367     /* finishnote -- stops the currently playing note */
368     /**/
369     finishnote(now)
370     begin
371         if (rampdone > now) begin /* can't ramp down until ramp up
371a        finishes */
372             stoprequest = true;
373         end else begin
374             /* amplitude ramps to zero in 20/100 sec: */
375             aramp(DECAY, 0, OSC_A);
376             accon = false;
377             rampdone = now + DECAY;
378         end
379     end
380
381
382     /* accmpny -- routine to implement the accompaniment process
382a    */
383     /**/
384     accmpny()
385     begin
386         int now;
387
388         /* Ramps cannot be aborted, so lock out all changes while
388a        ramp */
389         /*( is in progress (this "lockout untilI'm ready for
389a        change" */
390         /* would be useful in more sophisticated accompanist
390a        programs)*/
391
```

```
392     now = gettime();
393     if (rampdone > now) return 0;
394
395     /* accmpny has 6 states, half of which were handled by the
396         previous line of code.  The three states leading to
396a        decision-making are:
397
398         !accon && !stoprequest -> waiting to start a note
399         accon && !stoprequest -> waiting for the end of the
399a        note
400         accon && stoprequest -> waiting for the attack ramp to
401             finish in order to start a decay and abort the
401a            note
402         (!accon && stoprequest -> this combination never
402a        happens)
403     */
404
405     if (stoprequest) begin
406         accon = false;
407         stoprequest = false;
408         finishnote(now);
409     end else if (accon) begin /* note is playing, wait for
409a    release */
410         if (virttime() >= acctime[accx] + accdur[accx]) begin
411             finishnote(now);
412             if(accx == acclen) accdoneflag = true;
413         end
414     end else if (accx+1 > acclen) begin /* anything left to
414a    play? */
415         accdoneflag = true;
416     end else if (virttime() >= acctime[accx+1]) begin
417         accx++;
418         fdelay(scale(accomp[accx]), 0, OSC_A); /* set pitch */
419         aramp(ATTACK, MAXAMP, OSC_A); /* turn on amplitude*/
```

```
420             accon = true;
421             rampdone = now + ATTACK;
422         end
423     end
424
425
426 /* accupdate -- called when time is adjusted */
427 /**/
428 accupdate(i, now, vt)
429 int i; /* i is the index of the next accomp note */
430 int vt; /* vt is the current virtual time */
431 begin
432     /* case 1: if i agrees with accx+1, do nothing,
433         because we are at the right place in the accompaniment
434     */
435         if (i == accx+1) return 0;
436
437     /* case 2: if the next note (i) is the currently sounding
438     one, and if it should be starting now, keep playing it
439     */
440         if ((i == accx) && accon && (vt >= acctime[accx]))
441             return 0;
442
443     /* Otherwise, the accompaniment is playing the wrong
444     note.  Finish the current note and skip to the right place
444a    in the score:
445     */
446         if (i != accx+1) begin
447             if (accon) finishnote(now);
448             accx = i-1;
449             return 0;
450         end
451 end
452 /*************************************************************
```

```
453 match -- module that implements the pattern matching algorithm
454
455 imports:
456         wget(), wset(), wswap(), semiwindsize, windsize
457         accupdate(), gettime(), windinit(), solotime[],
458         sololink[], setref()
459 exports:
460         matchinit(), newinput()
461
462 This module should be initialized with matchinit.  Then for
463 each solo input, call newinput.  When a match is encountered,
464 newinput will call match(i), where i is the index into the
464a score of the current note.
465
466 ************************************************************/
467
468 int lastsolomatch,      /* solo index at last match */
469     lastinpmatch,       /* inputindex at last match */
470     seqlen,             /* maximum matching subsequent length
470a                          up to now */
471     inputx,             /* input index */
472     center;             /* window center */
473
474
475 /* matchinit -- initialize this module */
476 /**/
477 matchinit()
478 begin
479     int i;
480     /* IMPORTANT:  Assume that windows no larger than the
481         length of the solo performance score: */
482     if (windsize > sololen)
483         printf("ERROR: window is bigger than solo.");
484     lastsolomatch = 0;
```

```
485     lastinpmatch = 0;
486     s`qlen = 0;
487     inputx = 0;
488     center = semiwindsize;
489     windinit();
490     /* establish boundary conditions for match: */
491     wlocate(cur, semiwindsize);
492     for (i=0; 1 < windsize; i++) wset(cur, i, -i);
493     /* (cur and prv are swapped on entry to newinput()) */
494 end
495
496
497 /* match -- called when a match occurs, adjusts virtual clock
497a */
498 /**/
499 match(i)
500 int i;
501 begin
502     /* now we know what virtual time it is; */
503         setref(solotime[i]);
504     /* tell acc where we are: */
505         accupdatè(sololink[i], gettime(), solotime[i]);
506 end
507
508
509 /* max -- maximum of two integers */
510 /**/
511 int max(i, j)
512 int i, j;
513 begin
514     if (i >= j) return i; else return j;
515 end
516
517
```

```
518 /* newinput -- called whenever a new solo event is detected */
519 /**/
520 newinput(inp)
521 begin
522     int i,
523         guess;  /* used to guess where center should be */
524     inputx++;
525     wswap(); /* swap prv, cur */
526
527     /* Locate the window: the window center ought to be near
528     the index of the last solo match, but add one for every
529     input since then.
530         On the other hand, don't change the window location
530a        too much:
531             allow center to change by 0, 1, or 2 at most.
532
533         Guess will tell which way to move center:
534     */
535     guess = lastsolomatch + (inputx - lastinpmatch);
536
537     center++;                        /* increment by 1 */
538     if (guess > center) center++;        /* increment by 2 */
539     else if (guess < center) center--;  /* increment by 0 */
540
541     /* don't move window beyond range of solo score */
542     if ((center + semiwindsize) > sololen)
543         center = sololen - semiwindsize;
544
545     wlocate(cur, center);
546
547     /* compute the new window:
548
549     /* (there is lots of room for structure access
549a    optimization here) */
```

```
550     for (i = wfirst(cur); i <= wlast(cur); i++) begin
551         wset(cur, i, max(wget(prv, i), wget(cur, i-1) - 1));
552         if (inp == solo[i]) begin
553             wset(cur, i, max(wget(cur, i), 1+wget(prv, i-1)));
554             if (wget(cur, i) >= seqlen) begin
555                 seqlen = wget(cur, i);
556                 match(i);     /* we found a match */
557                 lastsolomatch = i;
558                 lastinpmatch = inputx;
559             end
560         end
561     end
562 end
563 /*************************************************************
564 control -- the main module
565 imports:
566         scoreinit(), pitchinit(), matchinit(), windinit(),
567         accinit(), virtinit(), accdoneflag, NONOTE
568 exports:
569         main()
570 *************************************************************/
571
572
573 /* init -- initialize all modules */
574 /**/
575 init()
576 begin
577     scoreinit();        /* read score */
578     pitchinit();        /* initialize other modules */
579     matchinit();
580     accinit();
581     musicinit();        /* synthesizer interface module */
582     virtinit();
583 end
```

```
584
585
586 main()
587 begin
588     int i;
589     init();
590     while (true) begin /* ^C to quit! */
591         if (!accdoneflag) accmpny();
592         i = readnote();
593         if (i !=NONOTE) newinput(i);
594     end
595 end
```

A listing of a further module providing dynamic grouping algorithm variation will be considered with this description preceding the actual listing.

The listing contains code that implements a matcher suitable for matching a polyphonic performance such as a keyboard against a polyphonic score. Unlike the listing for the monophonic program, this listing contains only program source code for the matcher, which uses a variation of the monophonic matching algorithm called dynamic grouping (DG). The additional routines necessary to form a complete accompaniment system are similar to those in the monophonic program, and the specifications for these other components are described below.

The dynamic grouping (DG) algorithm is similar to the monophonic matching algorithm described above. The main difference is that DG matches a sequence of symbols (notes) against a sequence of symbol sets (chords), also called compound events, while the previous monophonic algorithm matches a sequence against another sequence of symbols. The goal in either case is to find an association between the two sequences that maximizes a rating function. In this case, the rating function is the difference between the number of performed notes matched to an initial prefix of the score and the number of notes unmatched in that score prefix. A prefix of the score is a contiguous set of compound events including the first one.

The primary data structure is a matrix where columns are associated with performance symbols and rows are associated with score sets. Each matrix element consists of an integer called value, and a set called used. The value at row r, column c, will be the value of the rating function in the best association up to and including score set r and performance symbol c. The used set ar row r, column c, will contain the symbols matched in score set r in order to achieve the corresponding value. This extra bookkeeping allows the avoidance of matching two performance symbols to the same score symbol.

Line 1 includes standard input/output definitions, and line 2 includes definitions of some constants and data structures. The important data structures here are event and matchscore. An event structure represents a note in the score and has two fields; time is the starting time of the event, and pitch is the pitch of the event. A matchscore structure describes a score in a form convenient for use by the matcher. A matchscore has three fields; length is the number of compound events in the score, evt is an array of event structures in time order, and evtidx is an array of compound events. A compound event is represented by the index of its first event. For example if the $5^{th}$ compound event consisted of the $10^{th}$, $11^{th}$, and $12^{th}$ event in evt, then evtidx[5] would equal 10, and evtidx[6] would equal 13 (the index of the first event in the next compound event).

Lines 4 through 8 are convenient definitions for symbols. Lines 10 and 11 and calls to routine dprintf are helpful in debugging, but are not essential to the algorithm.

Line 13 declares mscore to be a pointer to a matchscore structure; mscore is the machine representation of the solo score.

Lines 15 through 24 define structures used for the windows. As in the monophonic matcher, only a window, or group of contiguous rows within a given column, is computed. While the monophonic matcher computed a matrix of integers representing the length of the best correspondence between performance and score, this polyphonic matcher computes a matrix of records of three components. The first of these is the length of the best correspondence as before and this length is called value. The second of these is the set of events in the corresponding compound event that were used in order to achieve the best correspondence. This set is called used. Line 18 defines a third component, last time, that allows timing information to be used to refine matching.

A window type is a structure containing an array of window elements (called window) as described above and a window offset that defines the origin of the window array.

Windows and pointers to them are declared in lines 26 and 28. Other variables are declared in lines 28 through 35: Last winner is the index of the last compound event that was matched, best yet is the highest matrix value obtained so far, evt center is the index into the evt array of the center of the window, evt guess is the expected index of the next matching event within evt, cevt center is the index of the center of the current window, cevt guess is the expected index of the next matching compound event within evtidx.

The used field of a window element represents a set of events. The representation is as follows: Events are numbered by their relative position within a compound event. The used field is a binary integer whose $i^{th}$ bit is one if and only if the $i^{th}$ event is a member of the set. This particular implementation allows 32 elements in a set.

The array i to s is a table used to convert a small integer into a set containing that integer.

Lines 42 through 59 are debugging aids and are not important to the functioning of the algorithm.

Lines 62 through 69 define the function MAX, which computes the maximum of two integers.

Lines 72 through 79 implement a routine to convert integer to sets containing those integers. The routine uses the table i to s to look up the answer provided the given integer is within an acceptable range.

Lines 82 through 94 counts the number of elements in a set by counting the number of bits set to one in the input parameter s.

Lines 97 through 15 implements a write operation on windows called putwnd. The parameters are: a window w, an index i, a value to write v, a used set to write u, and a third component to write l.

Lines 118 through 138 implement read access to windows by defining the routine getwnd. The parameters are the same as putwnd, except v, u, and l are output parameters. If the index is outside of the window, then zero is returned as the value of each output parameter.

Lines 141 through 157 can be used to print the value of a window, but is not an important part of the algorithm.

Lines 160 through 169 compute the size of a compound event by finding the difference between the start of the next compound event and the start of the current compound event.

Lines 172 through 189 define memberp that tells whether or not note, the first parameter, is a number of the $i^{th}$ compound event. If so, the corresponding index in the evt array is returned in the third parameter, evt loc, and the set representing that note is returned as the value of the function memberp. The function works by making a linear search of the notes in the indicated compound event (the loop for this starts on line 182), and returning as soon as the desired note is found. If the note is not found in the compound event, then the empty set (represented by 0) is returned.

Lines 192 through 217 initialize the matcher and should therefore be called when the accompaniment program is started. The initial window is initialized such that its origin is at zero, its used fields are empty (nothing has been used because nothing has been performed), and the value fields are the negative of the index of the compound event in evt. This is because the rating function assesses a penalty of one point for each note left unmatched in the score. Since no notes are matched in the beginning, the penalty is one point per note, so the rating is the negative of the note index.

The matching algorithm is executed by calls to process note, defined in lines 222 through 359; process note must be called once each time a performance event is read. The note parameter is the performance event. There are four output parameters: match is set to true if a match was found and false if no match was found, newtime is set to the current vitual time if a match was found, next cevt time is the virtual time of the next predicted compound event virtual time, and finally seq is set to true if a match occurred and if the match occurred in sequence as expected.

The process note routine can be divided into two parts: Lines 243 through 269 compute the location of the window in the column corresponding to the current performed event. This computation is identical to the computation of the window center in the monophonic matcher except that there are now two sets of indexes to deal with; one has to do with the array of compound events (evtidx) and the other has to do with the array of events (evt).

Lines 270 through 359 then compute the window. Aside from initialization, each cell is computed in terms of the previous cell in the same row, the cell in the previous row and previous column, and the cell in same column but previous rows.

An intuitive explanation of the algorithm follows. The basic idea is that one compute the best association up to a given window by extending the previously computed best associations up to (1) previous row of the previous column, (2) the previous row in the current column, and (3) the same row of the previous column. The highest resulting value is retained for use in computing further elements of the matrix.

Lines 277–283 handle case 2, extension from the previous row of the current column. This is only done if three is no match (otherwise, it would be no worse to apply case 1). The new value is computed as one less than the value of the previous row minus the number of unused events.

Lines 284–291 handle case 1, extension from the previous row of the previous column. These statements are executed if and only if there is a match between the performance event (note) and some element of the compound event for this row. The computed value is the value in the previous row and previous column incremented by one (credit for the match) minus the number of events left unmatched in the previous row.

Lines 293–320 handle case 3, extension from the same row but previous column. If there is a match and the matching note is not in the used set, then the computed value is the value in the previous column plus one. The used field is the union of used in the previous column and the set containing note. Lines 299–303 express an additional constraint that the elapsed time between performance events must be less than a specified fraction of the expected time to the next compound event in order to match within the same compound event. Otherwise, (see lines 324–329) if there is no match or the matching note is already in the used set, then the computed value is just the value from the previous column and used is also copied from the previous column.

Line 334 tests to see if the new value is greater than any previous value. If so, output parameters are set, and the location of the match is recorded.

To use the polyphonic matcher to provide accompaniment, a program could be organized as follows:

First, a module is necessary to initialize data structures and read music data into the score structures. Second, an input routine must be provided that can read performance input data as it becomes available. Third, a virtual clock is employed to allow accompaniment speed to change. Fourth, there must be an accompaniment module that reads a virtual clock and uses it to produce sound according to the accompaniment score, but with timing corresponding to the virtual clock. Examples of all of these except for a score-reader can be found in the monophonic program listings.

When executed, the accompaniment program would begin by initializing all its modules and reading the solo and accompaniment scores. Then a loop is entered in which the input routine is called to look for new input and the accompaniment routine is called to keep the sound output consistent with the current virtual time. Whenever an input is detected, it is passed to the routine process note to look for a match in the solo score. When a match is found, process note also returns the current virtual time. The virtual time is used to set the virtual clock and the clock effects the rate at which accompaniment is produced as in the monophonic program.

```
1   #include < stdio.h>
2   #include "pacer.h"
3
4   #define begin {
5   #define end }
6
7   #define false 0
8   #define true 1
9
10  extern char *deb_fmt_buf[];
11  extern int deb_val_buf[], debnum;
12
13  struct matchscore *mscore;          /* pointer to the solo */
14
15  typedef struct begin
16      int value;
17      int used;
18      int last_time;
19      end we_type;
20
21  typedef struct begin
22      int offset;
23      we_type window[WINDSIZE];
24      end ~~begin~~ window_type;
25
26  static window_type win1, win2;  /* window storage */
27          /* prev & curr are the windows used in matching: */
28  static window_type *prev, *curr, *temp_wind;
29   static int last_winner; /* the index of the last winning cevt
29a  */
```

```
30    static int best_yet;     /* the highest value obtained so far
30a                              */
31    static int evt_center;   /* the evt index of window center */
32    static int evt_guess;    /* the expected index of next matching
32a                              evt */
33    static int cevt_center;  /* the cevt index of window center */
34    static int cevt_guess;   /* the expected index of next matching
34a                              cevt */
35    static int nnote;        /* for debugging -- counts notes to
35a                              process */
36
37    static i_to_s[] = begin 1, 2, 4, 8, 16, 32, 64, 128, 256, 512,
37a                     1024, 2048, 4096,
38            1<<13, 1<<14, 1<<15, 1<<16, 1<<17, 1<<18, 1<<19,
39            1<<20, 1<<21, 1<<22, 1<<23, 1<<24, 1<<25, 1<<26,
39a           1<<27, 1<<28, 1<<29, 1<<30, 1<<31 end;
40
41
42    extern debug_out();
43
44    /* abort -- write out debug data and quit */
45    abort(msg)
46    char *msg;
47    begin
48        FILE *fopen(), *fp;
49        char name[32];
50
51        printf("ABORTED: %s\n", msg);
52        printf("File name for debugging output:  ");
53        scanf("%32s",name);
54        discard_line;
55        fp = fopen(name,"w");
56        debug_out(fp);
57        fclose(fp);
```

```
58          exit(1);
59      end
60
61
62      /* MAX -- max of two integers */
63      /**/
64      MAX(a, b)
65      int a, b;
66      begin
67          if (a > b) return a;
68          else return b;
69      end
70
71
72      /* int_to_set -- convert an integer to a set with that integer
72a     as element */
73      /**/
74      static int int_to_set(i)
75      int i;
76      begin
77          if (i < 32 && i >= 0) return i_to_s[i];
78          abort("from int_to_set");
79      end
80
81
82      /* num_in_set -- how many bits are on in s? */
83      /**/
84      static int num_in_set(s)
85      register int s;
86      begin
87          register int j, i;
88          j = 0;
89          for (i_0; i<32; i++) begin
90              if (s & 1) j++;
```

```
91          s = s >> 1;
92      end
93      return j;
94  end
95
96
97  /* putwnd -- write values into a window location */
98  /**/
99  static outwnd(w, i, v, u, 1) (lower case "L")
100 register window_type *w;     /* the window to update */
101 int i;  /* the index */
102 int v;  /* the value to write */
103 int u;  /* the used set to write */
(lower case "L")
104 int 1;  /* the last_time to write */
105 begin
106     register we_type *winentry;
107     if (i < w->offset || i >= (w->offset + WINDSIZE)) begin
108         printf("putwnd(%d, %d, %d, %x), offset=%d\n", w, i, v,
109         u, w->offset); abort("from putwnd");
110     end
111     winentry = &(w->window[i - w->offset]);
112     winentry->value = v;
113     winentry->used = u;
(lower case "L")
114     winentry->last_time = 1;
115 end
116
117
118 /* getwnd -- get the value and used fields from a window
118a location */
119 /**/
(lower case "L")
120 static getwnd(w, i, v, u, 1)
121 register window_type *w;     /* the window to update */
122 int i;   /* the index */
```

```
int *v;  /* the value */
int *u;  /* the used set */
(lower case "l")
int *1;  /* the last_time */
begin
    if (i < w->offset || i >= (w->offset + WINDSIZE)) begin
        *v = 0;
        *u = 0;
        (lower case "l")
        *1 = 0;
    end else begin
        register we_type *winentry;
        winentry = &(w->window[i - w->offset]);
        *v = winentry->value;
        *u = winentry->used;
        (lower case "l")
        *1 = winentry->last_time;
    end
end


/* showwnd -- print a window */
/**/
showwnd(w)
window_type *w
begin
                (lower case "l")
    int i, v. u, 1;
    dprintf("\n", 0);
    dprintf("(offset %d): ", s->offset);
    for (i = w->offset; i < (w->offset + WINDSIZE); i++) begin
                                (lower case "l")
        getwnd(w,i, &v, &u, &1);
        dprintf("[%d,", v);
        dprintf("%x,", u);
                (lower case "l")
        dprintf("%d] ", 1);
        if (i == w->offset + SEMIWINDSIZE) dprintf("\n ", 0);
    end
    dprintf("\n", 0);
```

```
157  end
158
159
160  /* size_of -- tells how many notes are in chord */
161  /**/
162  int size_of(i)
163  int i; /* cevt index */
164  begin
165      if (i >= mscore->length) begin printf("sizeof(%d)\n", i);
166                                  abort("from size_of"); end
167      if (i >= 0) return mscore->evtidx[i+1] -
167a     mscore->evtidx[i];
168      return 0;
169  end
170
171
172  /* memberp -- tells whether note is a member of ith cevt */
173  /**/
174  static int memberp(note, i, evt_loc) /* returns a set with the
174a note if found */
175  int note;        /* the note (eg 48 = middle c) */
176  int i;           /* the cevt index */
177  int *evt_loc;    /* if found, the evt index is returned here */
178  begin
179      int j;
180      if (i >= mscore->length) begin
181          printf("memberp %d", i); abort("from memberp"); end
182      for (j = mscore->evtidx[i]; j < mscore->evtidx[i+1]; j++)
182a     begin
183          if (note == mscore->evt[j]. pitch) begin
184              *evt_loc = j;
185              return int_to_set(j - (mscore->evtidx[i]));
186          end
187      end
```

```
188         return 0;
189     end
190
191
192     /* init_matcher -- initializes this module */
193     /**/
194     init_matcher(solo)
195     struct matchscore *solo;
196     begin
197         int i;
198         int x;
199         debnum = 0;
200         nnote = 0;
201         mscore = solo;        /* keep reference */
202         prev = &win1;
203         curr = &win2;
204         curr->offset = 0;
205         for (i = 0; i < WINDSIZE; i++) begin
206             x = mscore->evtidx[i]; /* coerce to integer */
207             curr->window[i] value = -x;
208             curr->window[i] used = 0;
209             curr->window[i] last_time = 0;
210         end
211         last_winner = -1;
212         best_yet = 0;
213         evt_center = -1;
214         evt_guess = -1;
215         cevt_guess = 0;
216         cevt_center = 0;
217     end
218
219
220     extern int t_real;        /* tells real-time */
221
```

```
222   /* process_note -- called when a performed note is started,
222a  looks for match */
223   /**/
224   process_note(note, match, newtime, next_cevt_time, seq)
225   int note;        /* the note played */
226   int *match;      /* set to true or false */
227   int *newtime;    /* if match, set to virt time */
228   int *next_cevt_time;     /* if match, set to next predicted
228a                           cevt virt time */
229   int *seq;        /* if match, tells whether match is in
229a                   sequence */
230   begin
231       int bottom, /* bottom of new window */
232           i,      /* loop index for building new window */
233           ismember,       /* true if note is a member of ith
233a                          cevt */
234           value,  /* the best value for the new ith cevt */
235           used,   /* the set of used notes in the ith cevt */
236           last_time,      /* the last time of the ith cevt */
237           evt_loc,        /* if ismember, this is index of note
237a                          that matches */
238           prev_val,       /* value of previous ith cevt */
239           prev_used,      /* used in previous ith cevt */
240           prev_last_time; /* last_time in previous ith cevt */
241
242       dprintf("PROCESS_NOTE %d\n", nnote);
243       nnote++;
244       /* find center of new window; (center is based on expected
244a      evt loc) */
245           evt_guess++;
246           if (evt_guess >= mscore->evtidx[mscore->length])
246a          evt_guess--;
247           if (cevt_guess >= mscore->length) begin
247a          abort("cevt_guess too big "); end
```

```
248         if (evt_guess >= mscore->evtidx[cevt_guess+1])
248a        cevt_guess++;
249         evt_center++;
250         if (evt_center < evt_guess) evt_center++;
251         else if (evt_center > evt_guess) evt_center--;
252         if (cevt_center >= mscore->length) begin
252a        abort("cevt_center too big"); end
253         while (evt_center >= mscore->evtidx[cevt_center+1])
253a        begin
254                 cevt_center++;
255                 if (cevt_center >= mscore->length) begin
256                     abort("cevt_center ran over");
257                 end
258         end
259     *match = false;
260     /* build window */
261         bottom = cevt_center - SEMIWINDSIZE;
262         /* make sure we keep window inside score */
263             if (bottom < 0) bottom = 0;
264             if (bottom + WINDSIZE > mscore->length) begin
265                 bottom = mscore->length - WINDSIZE;
266                 if (bottom < 0) begin abort("score too
266a                small"); end
267             end
268         temp_wind = curr; curr = prev; prev = temp_wind;
269         curr->offset = bottom;
270         for (i = bottom; i < bottom+WINDSIZE; i++) begin
271             ismember = memberp(note, i, &evt_loc);
272             if (ismember) begin
273                 dprintf("%d is, ", i);
274             end else begin
275                 dprintf("%d isnt, ", i);
276             end
277             /* consider skipping remaining cevt in score
```

```
277a                (down) */
278                     if (!ismember) begin
279                         getwnd(curr, i-1, &value, &used,
279a                        &last_time);
280                         value += -1 - (size_of(i-1) -
280a                        num_in_set(used));
281                         used = 0;     /* null set */
282   /*                    printf("vertical: %d, %d, %x ", i, value,
282a                        used); fflush(stdout);*/
283                     end
284                 /* consider matching (diagonal) */
285                     else begin
286                         getwnd(prev, i-1, &value, &used,
286a                        &last_time);
287                         value += 1 - (size_of(i-1) -
287a                        num_in_set(used));
288                         used = ismember;
289                         last_time = t_real;
290   /*                    printf("diagonal: %d, %d, %x ", i, value,
290a                        used); fflush(stdout);*/
291                     end
292                 /* consider matching (horizontal) */
293                     getwnd(prev, i, &prev_val, &prev_used,
293a                    &prev_last_time);
294                     if (i >= mscore->length) begin
295                         printf("oops %d", i);
296                         abort("from process_note");
297                     end
298                     if (ismember && !(prev_used & ismember) &&
298a                    prev_val >= value &&
299                         ((t_real - prev_last_time) <
300                         MAX(EPSILON,
301                             ((mscore->evt[mscore->
301a                             evtidx[i+1]].time -
```

```
302                     mscore->evt[mscore->evtidx[i]].time)
302a                  /
303                   EPS_FRAC)))) begin
304                if (!prev_used) begin
305                   printf("error: prev_used is empty ");
306                   printf("ismember %d, prev_used %d,",
307                        ismember, prev_used,");
308                   printf("i %d, prev_val %d,",
309                        i, prev_val());
310                end
311                value = prev_val+1;
312                dprintf("(hm %d\n", value);
313                dprintf("t_real %d, ", t_real);
314                dprintf("prev_last_time %d, ",
314a                  prev_last_time);
315                dprintf("next cevt time %d, ",
316                   mscore->evt[mscore->evtidx[i+1]].time;
317                dprintf("this cevt time %d)\n",
318                   mscore->evt[mscore->evtidx[i]].time;
319                used = prev_used | ismember;
320                last_time = t_real;
321   /*           printf("match horizontal: %d, %d, %x ", i,
322                   value, used); fflush(stdout); */
323             /* consider getting value from previous cevt
323a            (horizontal) */
324                end else if (prev_val > value) begin
325                value = prev_val;
326                used = prev_used;
327   /*           printf("nonmatch horizontal; %d, %d, %x ",
328                i, value, used); fflush(stdout);*/
329                end
330             /* update the window */
331                putwnd(curr, i, value, used, last_time);
332             /* see if we have a winner */
```

```
333     /*                  printf("value = %d, best_yet = %d ", value,
333a                        best_yet);*/
334                         if (value > best_yet) begin
335                             best_yet = value;
336     /*                      printf("last_winner = %d, i = %d ",
336a                                last_winner, i); */
337                             if (last_winner != i) begin
338                                 dprintf("(winner %d) ", best_yet);
339                                 *match = true;
340                                 *seq = (i == last_winner+1);
341                                 last_winner = i;
342                                 if (evt_loc < 0 ||
343                                      evt_loc >= mscore->evtidx[mscore
344                                      ->length]) begin
345                                          abort("from process_note");
346                                 end
347                                 *newtime = mscore->evt[evt_loc].time;
348                                 if (i == mscore->length-1)
349                                      *next_cevt_time = INFINITY;
350                                 else *next_cevt_time =
351                                      mscore->evt[mscore
351a                                      ->evtidx[i+1]].time;
352                                 cevt_guess = i;
353                                /* guess the index of the present note
353a                               as curr loc */
354                                evt_guess = mscore->evtidx[i] +
354a                               num_in_set(used) - 1;
355                             end
356                         end
357                 end
358             showwnd(curr);
359     end
```

It will be appreciated, therefore, that the present invention provides an effective means for monitoring the performance and through a unique matching approach coordinating accompaniment therewith. This is accomplished while obtaining the benefit of dynamic programming concepts in establishing correspondence between a storage sequence such as the performance score and a real-time input sequence such as the performance. The method and apparatus may be employed so as to derive information from each new performance event.

While for convenience of reference herein some functions have been indicated as being performed by software, it will be appreciated that if desired they may be performed by firmware or hardware.

While for purposes of clarity of disclosure herein reference has been made to a preferred musical performance and musical accompaniment, the invention is not so limited. For example, the accompaniment might be a visual slide presentation, light shows, dancing waters or other educational or entertainment devices controlled by the system of this invention.

Whereas particular embodiments of the invention have been described above for purposes of illustration, it will be evident to those skilled in the art that numerous variations of the details may be made without departing from the invention as defined in the appended claims.

I claim:

1. A computerized method of providing accompaniment for a performance during performance input comprising converting at least a portion of said performance into a sequence of performance sound related signals, effecting comparison between said sequence of performance sound related signals and a desired sequence of the performance score, if a predetermined match exists between said performance sound related signal and said performance score providing accompaniment for said performance, and in effecting said comparison permitting a performance sound related signal departure from said performance score while concluding that said comparison results in a match.

2. The computerized method of accompaniment of claim 1 including effecting said comparison on an event by event basis.

3. The computerized method of accompaniment of claim 2 including providing said performance as a musical performance.

4. The computerized method of accompaniment of claim 2 including employing as said events single or multiple musical notes.

5. A computerized method of providing accompaniment of claim 4 including employing algorithm means for effecting said comparison between said performance sound related signals and said performance score.

6. The computerized method of accompaniment of claim 5 including employing dynamic programming to effect said comparison.

7. The computerized method of accompaniment of claim 6 including employing windows in said dynamic programming to examine only a region of said performance score for each event of said performance sound related signal being monitored.

8. The computerized method of accompaniment of claim 6 including providing accompaniment means for initiating accompaniment to said performance, delivering a responsive signal to said accompaniment means when a match between a said performance sound event and a said performance score event exists, and delivering a desired accompaniment score to said accompaniment means.

9. The computerized method of accompaniment of claim 8 including providing accompaniment means for initiating accompaniment to said performance, and combining said responsive signal and a desired accompaniment score by said accompaniment means to initiate accompaniment synchronized to said performance by synthesis means.

10. The computerized method of accompaniment of claim 9 including uttering both said performance and said accompaniment from said synthesis means for synthesizing both said performance and said accompaniment.

11. The computerized method of accompaniment of claim 9 including emitting said accompaniment from said synthesis means, providing means other than said synthesis means for emitting said performance, and emitting said performance through said other means.

12. The computerized method of accompaniment of claim 8 including effecting timing of said accompaniment score in said accompaniment means.

13. The computerized method of accompaniment of claim 1 including confining said performance event departures that will be deemed to be a match to departures within a predetermined range.

14. The computerized method of accompaniment of claim 1 including permitting said departure to be addition of an event in the performance not in the performance score.

15. The computerized method of accompaniment of claim 1 including permitting said departure to be omission in the performance of an event in the performance score.

16. The computerized method of accompaniment of claim 1 including permitting said departure to be substitution of an event in the performance for another event in said performance score.

17. The computerized method of accompaniment of claim 5 including employing in said algorithm means means for determining a correspondence between events in said performance related signals and events in said performance score.

18. The computerized method of accompaniment of claim 17 including employing in said algorithm means means for determining the timing of an event in said performance as compared with the timing of said event in said performance score.

19. The computerized method of accompaniment of claim 7 including employing in said algorithm a rating system to evaluate matches between events as to degree of similarity.

20. Computerized apparatus for providing accompaniment for a performance during performance input comprising means for providing a sequence of performance sound related signals, performance score means for providing information regarding the desired sequence of said performance sound related signals, matching means for comparing said sequence of performance sound related signals with said performance score means to determine if a predetermined match exists and emitting match signals when a match exists, and accompaniment means for receiving said match signals and an accompaniment score.

21. The computerized apparatus of claim 20 including said matching means effecting a comparison on an event by event basis.

22. The computerized apparatus of claim 21 including said performance sound related signals and said performance score means being provided to said matching means in machine-readable form and said accompaniment score being provided to said accompaniment means in machine-readable form.

23. The computerized apparatus of claim 20 including said matching means including algorithm means for making said comparison of said performance sound related signals with said performance score means.

24. The computerized apparatus of claim 24 including said algorithm means having means for determining that a match exists even when a performance event not in the performance score occurs.

25. The computerized apparatus of claim 23 including matching means having means for determining that a match exists even when the performance omits an event present in the performance score means.

26. The computerized apparatus of claim 23 including matching means having means for determining that a match exists even when the performance substitutes an event for another event in said performance score.

27. The computerized apparatus of claim 25 including said algorithm means including dynamic programming.

28. The computerized apparatus of claim 27 including said algorithm means including window means for examining a region of said performance score for each event of said performance sound related signal being monitored.

29. The computerized apparatus for claim 27 including said accompaniment means having real-time clock means for timing said performance, and virtual time means for providing the predetermined timing of said performance score and said score accompaniment.

30. The computerized apparatus of claim 29 including said algorithm means providing said virtual time means.

31. The computerized apparatus of claim 29 including synthesis means for receiving accompaniment signals from said accompaniment means to thereby initiate accompaniment.

32. The computerized apparatus of claim 31 including said performance sound related signals containing information regarding the actual performance including information regarding musical notes, and said performance score means including musical notes.

33. The computerized apparatus of claim 32 including said algorithm means having means for comparing both the identity of musical notes and the relative timing of some of said musical notes with respect to other said musical notes.

34. The computerized apparatus of claim 33 including synthesis means emitting both said performance sound related signals and said accompaniment.

35. The computerized apparatus of claim 34 including said performance sound related signals having polyphonic sounds.

* * * * *

UNITED STATES PATENT AND TRADEMARK OFFICE

CERTIFICATE OF CORRECTION

PATENT NO. : 4,745,836

DATED : May 24, 1988

INVENTOR(S) : ROGER B. DANNENBERG

It is certified that error appears in the above-identified patent and that said Letters Patent is hereby corrected as shown below:

Col. 1, line 49, "knowm" should be --known--.

Col. 4, line 20, "determination" should be --determinations--.

Col. 4, line 28, "sound" should be --sounds--.

Col. 5, line 10, "will" should be --with--.

Col. 5, line 55, "seglen" should be --seqlen--.

Col. 7, line 25, "seglen" should be --seqlen--.

Col. 7, line 27, "seglen" should be --seqlen--.

Col. 14, line 19, "makes" should be --takes--.

Col. 51, line 60, "ar" should be --at--.

Col. 56, line 5, "effects" should be --affects--.

Signed and Sealed this

Tenth Day of January, 1989

*Attest:*

*Attesting Officer*

DONALD J. QUIGG

*Commissioner of Patents and Trademarks*